US010446896B2

(12) United States Patent
Sledkov et al.

(10) Patent No.: US 10,446,896 B2
(45) Date of Patent: Oct. 15, 2019

(54) ADJUSTABLE PHASE SHIFTING DEVICE INCLUDING BRANCHED FEED LINES WITH TRANSFORMER PORTIONS FOR FEEDING AN ANTENNA ARRAY

(71) Applicants: Victor Aleksandrovich Sledkov, Guangzhou (CN); Zi-Meng Li, Dongguan (CN)

(72) Inventors: Victor Aleksandrovich Sledkov, Guangzhou (CN); Zi-Meng Li, Dongguan (CN)

(73) Assignee: Zi-Meng Li, Dongguan, Guangdong (CN)

( * ) Notice: Subject to any disclaimer, the term of this patent is extended or adjusted under 35 U.S.C. 154(b) by 0 days.

(21) Appl. No.: 15/507,763

(22) PCT Filed: Sep. 11, 2015

(86) PCT No.: PCT/CN2015/094083
§ 371 (c)(1),
(2) Date: Mar. 1, 2017

(87) PCT Pub. No.: WO2016/074592
PCT Pub. Date: May 19, 2016

(65) Prior Publication Data

US 2017/0288306 A1 Oct. 5, 2017

(30) Foreign Application Priority Data

Nov. 11, 2014 (CN) ..... 2014 1 0630651

(51) Int. Cl.
*H01P 1/18* (2006.01)
*H01P 5/12* (2006.01)
(Continued)

(52) U.S. Cl.
CPC ..... *H01P 1/184* (2013.01); *H01P 1/18* (2013.01); *H01P 5/12* (2013.01); *H01Q 1/246* (2013.01);
(Continued)

(58) Field of Classification Search
CPC ..... H01P 1/184; H01P 1/18; H01P 9/00
(Continued)

(56) References Cited

U.S. PATENT DOCUMENTS 5,940,030 A * 8/1999 Hampel et al. .... H01Q 21/0006 333/161
2009/0224848 A1* 9/2009 Lindmark ..... H01P 1/184 333/159

* cited by examiner

*Primary Examiner* — Benny T Lee
(74) *Attorney, Agent, or Firm* — Karthik Murthy; Murthy Patent Law PLLC

(57) ABSTRACT

This paper discloses an adjustable phase shifting device for antenna array as well as an antenna array, the device including a branched network of feed lines containing transformer portions of varying width for reducing reflection of signals passing through the network and coupling the common input port with the output ports placed along the first edge of the device via one or more junctions and including portions of feed lines placed along the second edge of the device, the dielectric members mounted on one rod adjacent to these portions of feed lines and can be moved along ones to synchronously adjust the phase relationship between the output ports, the dielectric members having one or more transformer portions for reducing reflection of signals passing through the network, wherein the dielectric member mounted adjacent to portions of feed lines placed along the second edge of the device and connected with the first junction from input port contains transformer portions at both ends and other dielectric members contain trans-
(Continued)

former portions only at one end which overlap a portion of feed line placed along the second edge of the device.

16 Claims, 5 Drawing Sheets

(51) Int. Cl.
*H01Q 21/00* (2006.01)
*H01Q 23/00* (2006.01)
*H01Q 1/24* (2006.01)
*H01Q 3/32* (2006.01)

(52) U.S. Cl.
CPC ..... *H01Q 3/32* (2013.01); *H01Q 21/0075* (2013.01); *H01Q 23/00* (2013.01)

(58) Field of Classification Search
USPC ..... 333/161
See application file for complete search history.

ADJUSTABLE PHASE SHIFTING DEVICE INCLUDING BRANCHED FEED LINES WITH TRANSFORMER PORTIONS FOR FEEDING AN ANTENNA ARRAY

FIELD OF INVENTION

The invention relates to a dielectric phase shifting device, more particularly an adjustable phase shifting device for an antenna array as well as an antenna, for feeding signals between a common line and two or more ports, for example for feeding radiators of an antenna array from an antenna input.

BACKGROUND OF THE INVENTION

The electrically adjustable antenna for a base station facilitates tilt adjustment of a beam of the base station antenna via a phase shifter in beam-forming networks, characterized in wide-range tilt adjustment, high precision, easily-managed direction pattern, strong capacity of resisting disturbance, and easy control. The Phase shifter acting as an essential component of base station antenna can adjust tilt angle of an antenna beam by changing the relative phase between antenna units, thus providing an improved communication network. In principle, a beam-forming network for electrically adjustable antenna can be formed in two methods. One is to insert a dielectric into feed line to alter the dielectric constant during transmission, thus to change the wavelength of the electromagnetic wave to suit the change of the travelling electromagnetic wave, meaning the change of the feed phase. Thus changing the wavelength of the electromagnetic wave is equivalent to a change in the feed phase. The change of feed phase refers to the fact that if the length of the feed striplines is changed a small amount, then there will be a big change in the phase shift, relative to the first scenario. The other is to alter the length of feed lines either by increasing or decreasing, which means to increase or decrease the route of electromagnetic wave directly so as to change the feed phase, wherein the changes to the feed lines are small and loss is minimal, yet some implementations would cause non-linear changes of the phase, complicated achievement or bad intermodulation.

A beam-forming network is previously known in U.S. Pat. No. 5,949,303, wherein phase shift is achieved by a dielectric member moving between a substrate and meander-shaped feed network, and the phase difference between different output ports achieved by transmission line dielectric of the feed network covering different lengths. The disadvantage: the meander-shaped loops are parallel so the device is relatively large in the lateral direction. Further, the relative position of output break, that is the relative position of the output port, will affect distribution, which goes against reducing signal reflection and designing components with broadband response, and adding to the complexity of phase shifter structure, even in contradiction with reality in some applications.

A beam-forming network is previously known in CN1547788A, wherein the phase shift among a plurality of ports is achieved by relative sliding between a highly-integrated circuit board and thin dielectric plate, similar to that described in U.S. Pat. No. 5,949,303. However, it is difficult to guarantee that the too-thin dielectric plate will remain the same due to the material and mechanical strength, and the phase shifter may get completely jammed or the phase shift precision may be affected due to an uneven force that the deformed dielectric plate created as a result of the movement. This is because the deformed dielectric plastic plate will bear uneven force when moving.

As stated previously, current technology apparently encounters defect and inconvenience in actual use. Yet the fast-pacing mobile communication technology advances the trend of miniaturization, broadband and multi-frequency related to base station antenna, demanding new phase shifter structures of low-cost but high performance to deal with the said issues.

SUMMARY OF THE INVENTION

This application is intended to provide a novel structure for improving beam-forming network and related application with a view to deficiency of current beam-forming network. A technical proposal is presented as follows:

This application discloses an adjustable phase shifting device for antenna array for feeding signals between a common input port and two or more output ports, the device including a branched network of feed lines containing transformer portions of varying width for reducing reflection of signals passing through the network and coupling the common input port with the output ports placed along the first edge of the device via one or more junctions and including portions of feed lines placed along the second edge of the device, the dielectric members mounted on a rod adjacent to these portions of feed lines and can be moved along ones to synchronously adjust the phase relationship between the output ports, the dielectric members having one or more transformer portions for reducing reflection of signals passing through the network, wherein the dielectric member mounted adjacent to portions of feed lines placed along the second edge of the device and connected with the first junction from input port contains transformer portions at both ends and other dielectric members contain transformer portions only at one end which overlap a portion of feed line. The branched network of feed lines consist of strip lines placed inside of the conductive box having two wide walls placed above and below strip lines and two narrow walls. The strip lines connected with the output ports contain dielectric substrates placed between wide walls on both sides of strip lines, and also contain nonconductive spacers supporting the strip lines between wide walls. Each dielectric member contains two equal parts placed between wide walls on both sides of each portion of strip line placed along the second edge of the device and fixed on a rod. Each dielectric member made as one part contains a longitudinal slot for strip lines and a longitudinal hole or channel for the rod, the inside surface of the slot is positioned with chamfers for strip lines and lugs for mounting the dielectric members on the rod by installation these lugs into holes made in a rod.

It should be noted that conventional adjustable phase shifting device for antenna array is placed in an independent cavity which is on a rear face of reflecting plate and supported by pillars, and conventional antenna array is connected with cables. The key point about the adjustable phase shifting device or antenna array as claimed in this application is replacing cables with strip lines, thus reducing thickness of the device and base station antenna as well as dimension of antenna. In one embodiment of this application the reflecting plate and phase shift cavity are made as one part sharing the same surface, while in current designs, they are separate components wherein a phase shifter is supported on the reflecting plate and where the parts of the drive mechanism for the phase shifter are higher than the phase shifter cavity, resulting in an increased height of the antenna. The phase shifting device and strip lines are directly placed in the reflector chamber in this application, the drive mechanism is implanted in the phase shifter, thus greatly reducing overall thickness of the antenna. The adjustable phase shifting device for antenna array as claimed in this application using strip lines: firstly, compared with cables, strip lines boast low loss acquiring better benefit. Secondly, strip lines free of cables greatly decrease soldering points to reduce chance of intermodulation during production and raise first pass yield during antenna production, and consistency of standing waves is good as well. Thirdly, real automation can be facilitated due to the modularity of components, achieving easy manufacturing and installing. Fourthly, strip lines can be manufactured by metal stamping in case of mass production, boasting low cost and high efficiency. Fifthly, the adjustable phase shifting device for antenna array as claimed in this application wherein antennas of varying perpendicular direction patterns can be designed in accordance with requirement just by altering strip line structure. Sixthly, the adjustable phase shifting device for antenna array in this application wherein if an antenna array has N radiators, the device can be placed with N−1 phase shifters all of which can be finely accommodated inside the reflector chamber without any increase in dimension, while existing antenna can accommodate only 1-5 phase shifters.

Preferably, transformer portions of the dielectric members formed by cuts reducing width of the dielectric members.

Preferably, transformer portions of the dielectric members formed by cuts reducing thickness of the dielectric members.

Preferably, the rod made of material having small thermal extension, for example metal or fiberglass.

Preferably, the feed lines consist of strip lines placed inside of the conductive cavity having two wide walls placed above and below strip lines and two narrow walls.

Preferably, the conductive cavity made as a metal profile by extrusion.

Preferably, a conductive cavity contains the longitudinal projections on the inner surfaces of wide walls nearby the second edge of the device.

Preferably, each dielectric member contains two equal parts placed between wide walls on both sides of each portion of strip line placed along the second edge of the device and fixed on a rod.

Preferably, each dielectric member made as one part containing the longitudinal slot for a strip line and the longitudinal hole or channel for the rod.

Preferably, each dielectric member contains the longitudinal slots for the longitudinal projections placed on inner surfaces of wide walls.

Preferably, each dielectric member is made of upper and lower layers and a plastic profile made by extrusion.

Preferably, each dielectric member made as one part containing the longitudinal slot for a strip line and the lugs for mounting the dielectric member on a rod by installation these lugs into holes made in a rod.

Preferably, the dielectric member made by injection in a mold has at least one gap for adjusting the contact between the dielectric member and the feed network.

Preferably, at least some portions of the strip lines connected with output ports contain dielectric substrates placed between wide walls on both sides of strip lines.

Preferably, dielectric substrates made of material having low dielectric constant, preferably polyethylene foam.

Preferably, at least some portions of the strip lines connected with output ports contain nonconductive spacers supporting the strip lines between wide walls.

Preferably, the strip lines formed on one side of the lower dielectric substrate supporting the strip lines between wide walls.

Preferably, the upper dielectric substrate is placed on the strip lines formed on the lower dielectric substrate.

Preferably, the strip lines formed on both sides of the thin dielectric substrate supporting the strip lines between wide walls.

Preferably, at least one feed line placed between a junction and an output port contains the portion having wave impedance at least 20% more than impedance of the output port and the transformer portion connected to an output port.

Another embodiment of the present invention is an antenna including the device as claimed wherein at least two antenna elements connected to outputs of the device directly or via coaxial cables.

The beneficial effect of this application: the adjustable phase shifting device for antenna array is designed based on phase shift method of inserting dielectric, characterized in highly integrated feed network, adoption of strip lines for connecting, free of nonlinear electric connection point and fine intermodulation. The dielectric member placed in the guide slot boasts small transmission error, high-precision declination and smooth transmission. In addition, phase shift calibration is of linear change during movement of the dielectric member.

The highly-integrated feed network free of cables makes insertion loss of the entire circuit very small, approximately 0.3 dB in the case of 3 GHz. Base station antenna using this design would have higher gains.

The adoption of metallic strip lines for the highly-integrated feed network free of cables can be made by stamping process which costs less than cables.

The highly-integrated feed network free of cables can be designed as a modular component allowing for realization of automation, reducing labor force by 80% and cutting cost as a result. Yet automatic production by robots is impossible in design of cables.

DETAILED DESCRIPTION OF THE INVENTION

Figure 1:
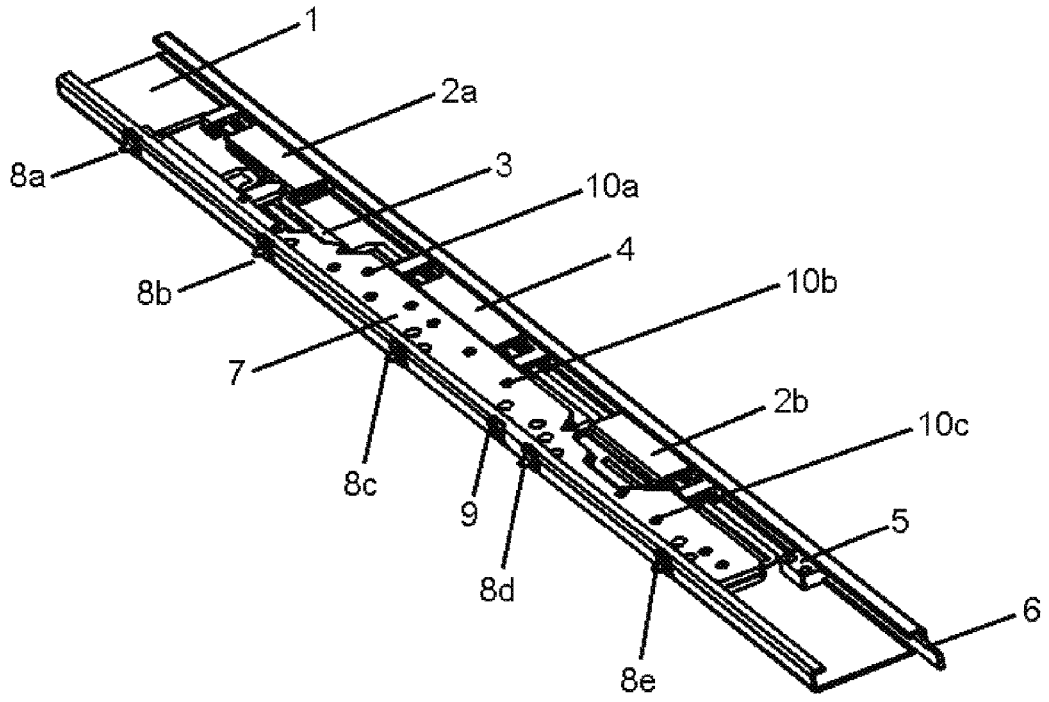
FIG. 1 is a drawing of internal structure of beam-forming network of one embodiment.

The adjustable phase shifting device for antenna array comprises input port, at least two output ports, a feed network for connecting input port with output ports, dielectric substrates for supporting feed network, a rod, dielectric members fixedly mounted on the rod and metallic rectangular cavity. The highly integrated feed network for connecting antenna elements has integrated strip lines instead of the cables and is secured between two dielectric substrates. Two ends of conductive cavity are open while other end faces are closed to form a rectangular cavity on one side of which the feed network mounted with dielectric members is placed. The dielectric members mounted on the rod according to the design and having guide slot which clip the strip lines between the upper and lower layer. The other side of the metallic cavity is placed with a guide slot and a guide projection, the guide projection is located in the guide slot for dielectric members. That is, the guide slot of the dielectric block is placed in the guide convex plate of the metallic cavity, while the rod is placed in the guide slot of the metallic cavity such that the dielectric members can move on the planar surface of the feed network by pulling the rod. The dielectric blocks are fixed on the rod, where the dielectric block can move on the planar surface of the feed network by pulling the rod.

This new-type of beam forming network illustrates that if an antenna array has N radiators, the beam forming network would have N−1 phase shifters, to achieve a good direction pattern both horizontally and vertically. Further, in this design, the feed network for connecting antenna array units has integrated strip lines instead of cables.

The feed network, which is highly integrated for connecting antenna array units and uses integrated strip lines instead of cables, are secured between two symmetrical dielectric substrates upon which is placed with fixed holes for corresponding feed network. The dielectric substrates must be a little longer than the feed network while the feed network must be wider than the dielectric substrates, the input and output ports of the feed network having no dielectric substrates to overlap them.

In this application, if an antenna array has N radiators, the beam forming network would have N−1 phase shifters.

The cavity for feed network installation is a rectangular conductive cavity with two open ends, side wall of the narrower side of the cavity placed with mounting hole for input and output ports, while surface of the wider side placed with mounting hole for dielectric substrate.

Inside the conductive cavity, one side has the guide slot and guide projection, and the side with the mounting hole has the feed network placed with dielectric substrate. Dielectric members are secured on the rod with up-down symmetry and with a narrow deep slot down to the bottom which is not running through.

The strip lines are in the middle of the narrow deep slot related to the dielectric members one side of which has a guide slot. On the dielectric members there are one or more gaps whose shape and quantity are determined by design, and on one side at the bottom there are hot-riveting pillars for fixing the fiberglass rod. The dielectric members, either made by two dielectric sheets or made as an entirety, has a chamfer for strip lines, and the slide rod mounted with dielectric members is positioned on one side of the conductive cavity where guide slot and guide projection are placed, a small separated cavity having input and output ports inside is positioned on the other side. The conductive cavity placed with feed network is configured by single- or multi-layer cavity.

A more detailed description of this application may be acquired by referring to the following embodiments in cooperation with the accompanying drawings. The embodiments are for the understanding and description of this application, but should not be interpreted as a limitation on this application.

In regards to all figures, like features are described by like reference numerals.

Embodiment One

Figure 2:
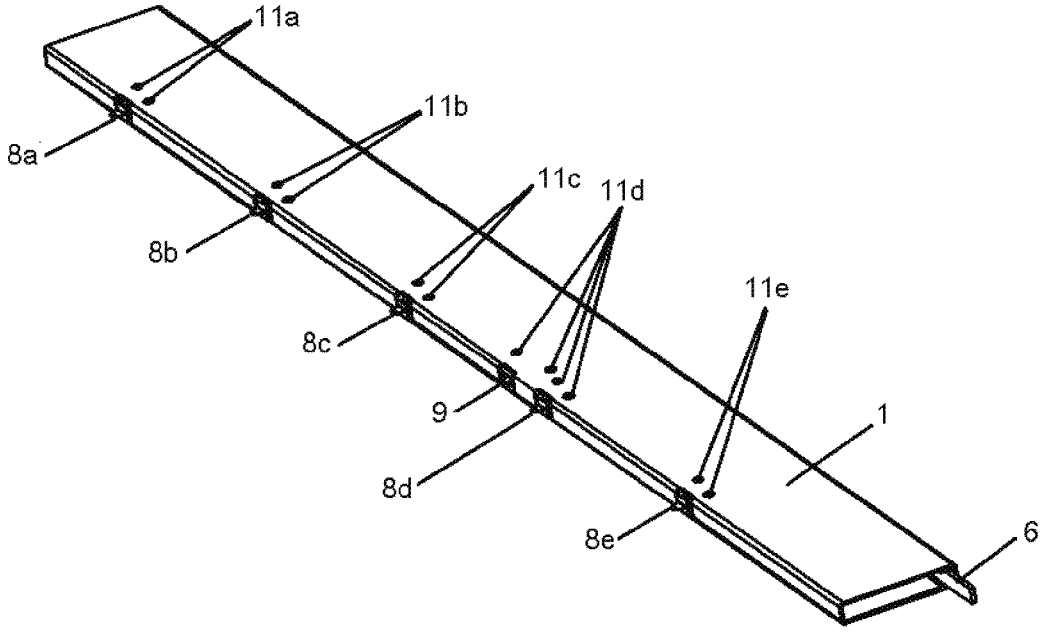
FIG. 2 is a drawing of general appearance of beam-forming network of one embodiment.
Figure 3:
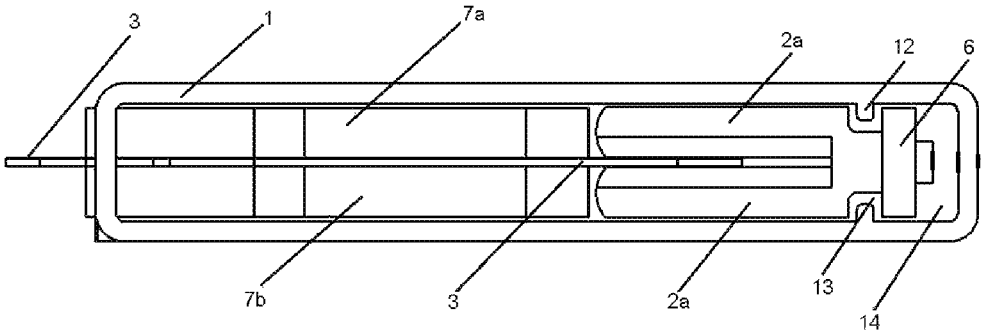
FIG. 3 is a drawing of overall cross section of beam-forming network of one embodiment.

The beam-forming network for the electrically adjustable antenna as claimed in this application referring to FIGS. 1-3. FIG. 1 illustrates embodiment one of this application including output ports 8*a*, 8*b*, 8*c*, 8*d* and 8*e*, input port 9, a drive mechanism comprising dielectric members 2*a*, 2*b* and 4, a fiberglass rod 6, a slide block 5, the fiberglass rod 6 having fixed holes through which the dielectric members 2*a*, 2*b* and 4 having plastic pillars on one side respectively are secured on the fiberglass rod 6 by means of riveting process. That is, the slide block 5 is fixed on the rod, all dielectric blocks are fixed on the rod also, and slide block 5 pulls all dielectric blocks moving on the surface of feed strip lines, (feed strip lines is fixed with the metallic cavity). Therefore, the slide block 5 will bear the maximum force in the moving process. We pull the slide block 5 only. Because of the strong pulling force the slide block 5 has to may potentially endure, POM is selected for production. POM is polyformaldehyde, it is a kind of plastic.

FIG. 1 further includes one side of a metallic cavity 1, and holes for rivets 10*a*, 10*b*, and 10*c*.

FIG. 3 further includes output ports strip line 3, dielectric substrate 7*a* and dielectric substrate 7*b*. FIG. 3 also includes dielectric blocks, where a pin is inserted into the hole of the rod, and fixes dielectric blocks on the rod.

The slide block 5 also has columns secured on the fiberglass 6 by riveting process. Strip lines 3 are clipped between the two same-type dielectric substrates 7*a* and 7*b* which have fixing holes 10*a*, 10*b* and 10*c* through which the strip lines 3 are firmly clipped between the two substrates 7*a* and 7*b* by plastic fasteners or plastic-heat riveting. One side of the metallic cavity 1 has gaps in which the output ports 8*a*, 8*b*, 8*c*, 8*d* and 8*e* and the input port 9 of the feed network are placed. As in FIG. 1, the strip lines 3 placed with dielectric substrates 7*a* and 7*b* are secured inside the metallic cavity 1 in FIG. 2 via plastic rivets 11*a*, 11*b*, 11*c*, 11*d* and 11*e*, the output ports 8*a*, 8*b*, 8*c*, 8*d*, 8*e* and the input port 9 are secured outside. The fiberglass rod 6 can be used as ruler.

Figure 4:
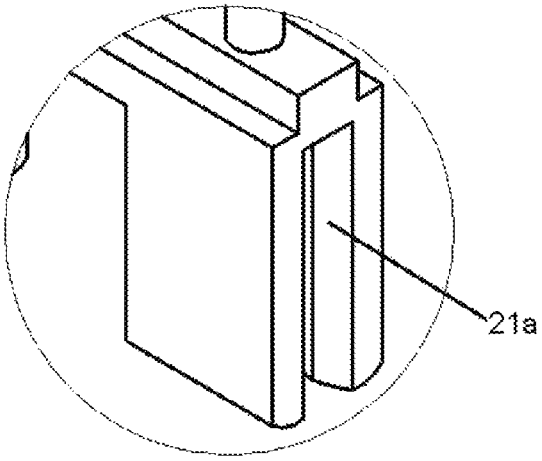
FIG. 4 is a drawing of partial enlargement of dielectric member of one embodiment.

FIG. 3 shows a sectional view of the entire conductive cavity. The fiberglass rod 6 is placed inside the guide slot 14 of the conductive cavity 1. In FIG. 1, on the dielectric members 2*a*, 2*b* and 4 is the guide slot 13 placed on the guide projection 12 of the conductive cavity 1. FIG. 4 illustrates the dielectric members having a chamfer 21*a* used for guiding the strip lines during phase shift adjustment. Strip lines 3 are placed inside the slot in the dielectric members 2*a*, 2*b* and 4 which would move along in the guide slot and guide projection of the metallic cavity when pulling the slide carriage. This configuration can avoid mechanical strength issue caused by long dielectric members, with the outcome of high-precision phase shift as well as low cost.

Embodiment Two

Figure 5:
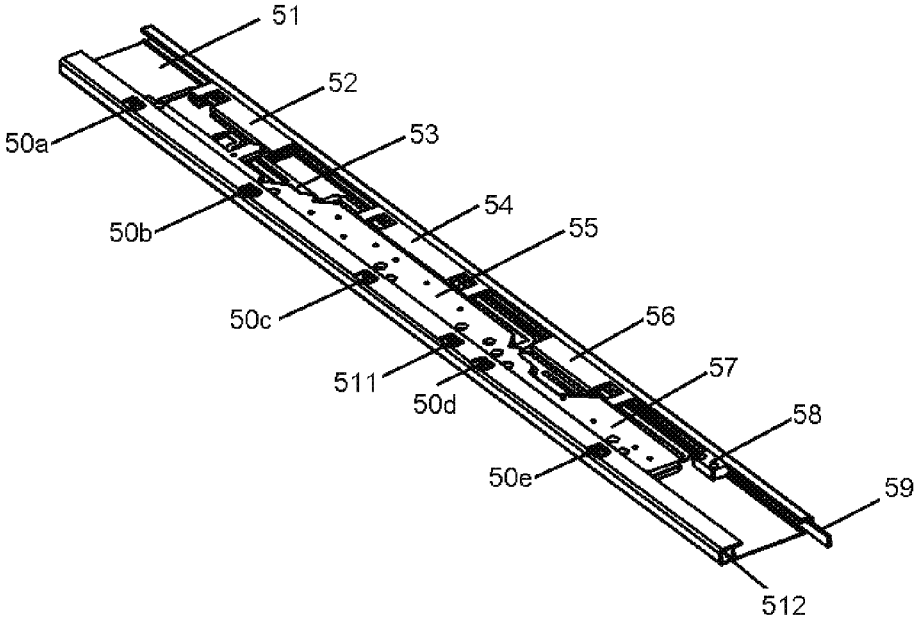
FIG. 5 is a drawing of internal structure of beam-forming network of another embodiment
Figure 6:
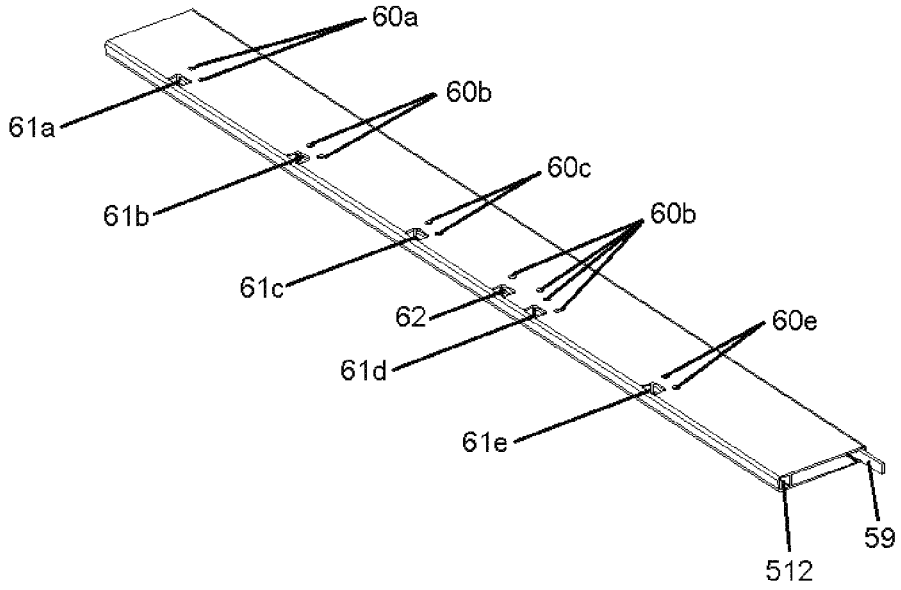
FIG. 6 is a drawing of general appearance of beam-forming network of another embodiment.
Figure 7:
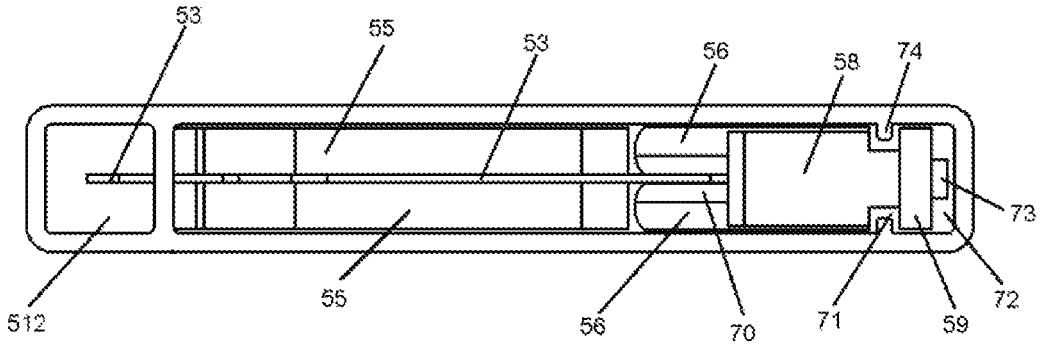
FIG. 7 is a drawing of overall cross section of beam-forming network of another embodiment.

The beam-forming network of the electrically adjustable antenna of this embodiment is shown in FIGS. 5-7. The base station of this case is similar to that of embodiment 1.

Just one end of where the input ports 50*a*, 50*b*, 50*c*, 50*d*, 50*e* and the output port 511 are positioned has a small cavity 512, as in FIG. 5. On the metallic cavity 51 are holes 50*a*,

50*b*, 50*c*, 50*d*, 50*e*, 511, strip lines 53, dielectric substrates 55, and mounting hole 57, the strip lines 53 being firmly clipped between the two same dielectric substrates 55 via plastic fasteners or plastic-heat riveting and on the same half of the metallic cavity with the input ports 50*a*, 50*b*, 50*c*, 50*d*, 50*e* and the output port 511. The dielectric members 52, 54 and 56 as well as the slide carriage 58 made of POM are fixed on the fiberglass rod 59 via plastic-heat riveting. POM is polyformaldehyde, it is a kind of plastic. FIG. 7 shows riveting point 73, fiberglass rod 59 placed in guide slot 72, slide carriage 58 and dielectric member 56 sharing guide slot 71 and placed in guide projection 74. The dielectric members have slots and chamfer 70 in cross section respectively for adjusting and leading the strip lines when pulling the rod 59. FIG. 6 illustrates metallic cavity having holes 60*a*, 60*b*, 60*c*, 60*d* and 60*e* through which the dielectric substrates 55 and the strip lines 53 from FIG. 5 are secured in the cavity via plastic rivets. 61*a*, 61*b*, 61*c*, 61*d*, 61*e* are holes on the cavity surface for output ports while 62 is an input port. 512 is a small cavity for closing input and output ports, which can effectively suppress coupling in dual-polarized antennas.

FIG. 6 further includes a rod 59.

FIG. 7 further includes strip lines 53, dielectric substrates 55, a slot chamber of dielectric blocks 70, a small metallic cavity 512 for output ports of strip lines.

Embodiment Three

Referring to FIGS. 8-11, the beam-forming network device for electrically adjustable antenna of this embodiment wherein the device is actually the result of overlapping two of the beams forming the network described in embodiment one. That is, the device includes two layers of a metallic cavity, wherein each metallic cavity is placed in the feed Strip lines network, and the feed Strip lines of each metallic cavity are connected by a small strip line, such that the two layers of feed Strip lines will become one beam-forming network.

Figure 9:
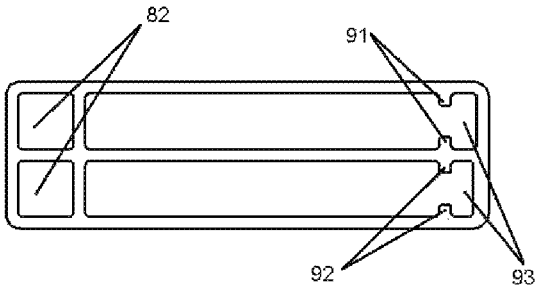
FIG. 9 is a drawing of cross section of double-deck metallic cavity of aggregate beam forming network device of one embodiment.

FIG. 9 further includes a small metallic cavity 82 for output ports of strip lines, guide convex plates 91 and 92, and a guide slot 93 for rods.

Figure 10:
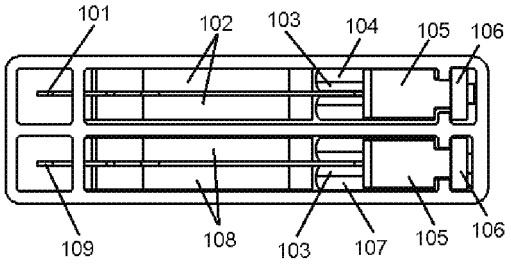
FIG. 10 is a drawing of overall cross section of aggregate beam forming network device of one embodiment.

FIG. 10 further includes slot chambers 103 of dielectric blocks 104 and 107. FIG. 10 also includes a fiberglass rod 106, a slide carriage 105, line and anchor.

Figure 8:
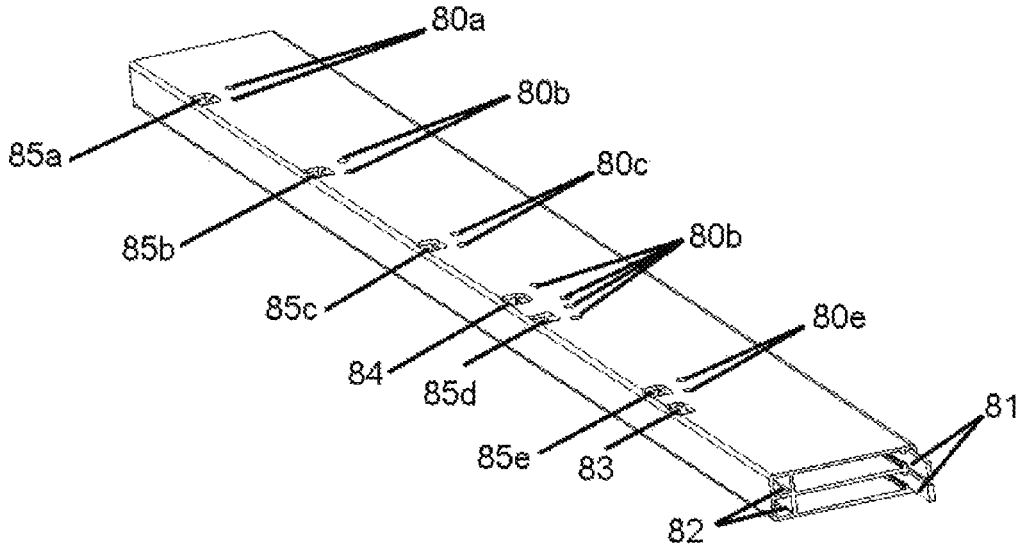
FIG. 8 is a drawing of general appearance of aggregate beam forming network device of one embodiment.
Figure 11:
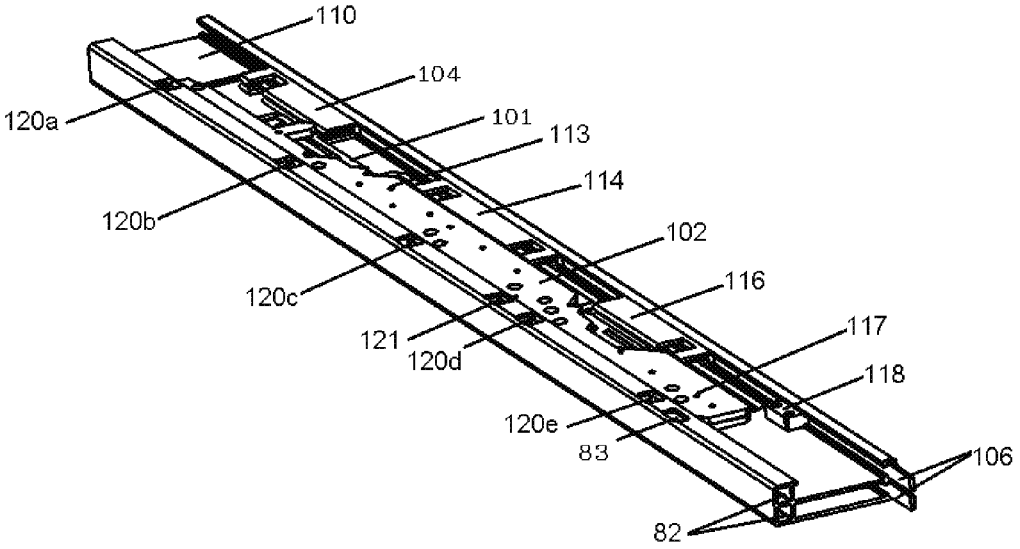
FIG. 11 is a drawing of internal structure of aggregate beam forming network device of one embodiment

FIG. 11 shows internal structure of the first layer including metallic cavity 110, feed network which is placed inside the cavity, strip lines 101 mounted between two dielectric substrates 102 and secured by fasteners through holes 113 and 117 on the side where the input port 121, output ports 120*a*, 120*b*, 120*c*, 120*d*, 120*e* and the support end 83 are placed. The slide rod 106 is positioned with dielectric members 104, 114, 116 and slide carriage 118. The metallic cavity 110 has on one side a small cavity 82 in which the input and output ports are placed. There are holes on the two dielectric substrates 102, and rivets will fix the two dielectric substrates 102 and the strip lines between two dielectric substrates 102. FIG. 8 shows a double-layer cavity, and fixing holes 80*a*, 80*b*, 80*c*, 80*d*, 80*e* which have plastic rivets inside and which are on the surface of the cavity for output ports, 84 is a hole for the input ports, 83 is a support port, 81 is a small cavity and 82 is a small cavity, wherein 81 and 82 are two overlapping but independently separated small cavities in which input and output ports are placed.

Parts 85*a*, 85*b*, 85*c*, 85*d*, 85*e* are each holes for the input ports.

Refer to FIG. 10 for more detailed illustration wherein strip lines 101 and 109 are clipped between dielectric substrates 102 and 108 in the overlapping cavities, and are placed in right the middle of the slots on the dielectric members. Dielectric members 104 and 107 have chamfers 103 for guiding the strip lines. Fiberglass rod 106 is placed in the guide slot of the cavity while slide carriage 105 is in guide projection such that the whole unit can move smoothly in the cavity when pulling the fiberglass rod 106. This embodiment is suitable for long antenna or multi-frequency antennas, wherein a long antenna means the antenna has 10 dipoles or more than 10 dipoles, because these antennas need more room for strip lines including a power driver of 9 phase shifts or more, and a one-layer metallic cavity is not enough.

FIG. 11 further includes a small metal cavity 82 for output ports of strip lines.

While the foregoing have been merely preferred embodiments related to this application, it should not be interpreted as a limitation on the scope of this application. Those skilled in the art will recognize that various changes, modifications and equivalents may be made without departing from the spirit and scope of the invention.

The invention claimed is:

1. An adjustable phase shifting device for feeding signals between a common input port and two or more output ports, the device including a branched network of feed lines containing a first transformer portion for reducing reflection of signals passing through the network, and a second transformer portion for coupling the common input port with the two or more output ports placed along a first edge of the device via one or more junctions and including portions of feed lines placed along a second edge of the device, wherein dielectric members mounted on one rod are adjacent to the portions of feed lines placed along the second edge of the device and can be moved along the feed lines to synchronously adjust the phase relationship between the two or more output ports, the dielectric members having the first transformer portion for reducing reflection of signals passing through the network, wherein one of the dielectric members is mounted adjacent to the portions of feed lines placed along the second edge of the device and connected with a first one of the one or more junctions from the common input port contains the first transformer portion for reducing reflection of signals passing through the network wherein the second transformer portion is only at one end of the device which overlaps the portions of the feed lines placed along the second edge of the device.

2. The device of claim 1 wherein the first transformer portion of the dielectric members is formed such that the width of the dielectric members is reduced.

3. The device of claim 1 wherein the first transformer portion of the dielectric members is formed such that the thickness of the dielectric members is reduced.

4. An adjustable phase shifting device for feeding signals between a common input port and two or more output ports, the device including a branched network of feed lines containing a first transformer portion for reducing reflection of signals passing through the network, and a second transformer portion for coupling the common input port with the two or more output ports placed along a first edge of the device via one or more junctions and including portions of feed lines placed along a second edge of the device, wherein dielectric members mounted on one rod are adjacent to the portions of feed lines placed along the second edge of the device and can be moved along the feed lines to synchronously adjust the phase relationship between the two or more output ports, the dielectric members having the first transformer portion for reducing reflection of signals passing through the network, wherein one of the dielectric members is mounted adjacent to the portions of feed lines placed along the second edge of the device and connected with a first one of the one or more junctions from the common input port contains the first transformer portion for reducing reflection of signals passing through the network wherein the second transformer portion is only at one end of the device which overlaps the portions of the feed lines placed along the second edge of the device;

wherein the feed lines consist of strip lines placed inside of a conductive box having two wide walls placed above and below strip lines and two narrow walls;

wherein the rod is made of fiberglass.

5. An adjustable phase shifting device for feeding signals between a common input port and two or more output ports, the device including a branched network of feed lines containing a first transformer portion for reducing reflection of signals passing through the network and a second transformer portion for coupling the common input port with the two or more output ports placed along a first edge of the device via one or more junctions and including portions of feed lines placed along a second edge of the device, wherein dielectric members mounted on one rod are adjacent to the portions of feed lines placed along the second edge of the device and can be moved along the feed lines to synchronously adjust the phase relationship between the two or more output ports, the dielectric members having the first transformer portion for reducing reflection of signals passing through the network, wherein one of the dielectric members is mounted adjacent to the portions of feed lines placed along the second edge of the device and connected with a first one of the one or more junctions from the common input port contains the first transformer portion for reducing reflection of signals passing through the network wherein the second transformer portion is only at one end of the device which overlaps the portions of the feed lines placed along the second edge of the device;

wherein the feed lines consist of strip lines placed inside of a conductive box having two wide walls placed above and below strip lines and two narrow walls;

wherein the conductive box contains longitudinal projections on inner surfaces of the two wide walls nearby the second edge of the device.

6. The device of claim 5 wherein the feed line placed between a first of the one or more junctions and the output port contains the portion having wave impedance at least 20% more than impedance of the output port.

7. The device of claim 5 wherein the strip lines are formed on one side of a lower dielectric substrate supporting the strip lines between the wide walls.

8. The device of claim 5 wherein each dielectric member contains two equal parts placed between the wide walls on both sides of each portion of a strip line placed along the second edge of the device and fixed on the rod.

9. The device of claim 8 wherein each dielectric member is made of upper and lower layers.

10. The device of claim 8 wherein each dielectric member contains longitudinal slots for the longitudinal projections placed on inner surfaces of the wide walls.

11. The device of claim 5 wherein the strip lines are formed on both sides of a dielectric substrate supporting the strip lines between the wide walls.

12. The device according to claim 5 wherein an upper dielectric substrate is placed on the strip lines formed on a lower dielectric substrate.

13. The device of claim 5, wherein each dielectric member is made as one part containing a longitudinal slot for a strip line;

wherein the dielectric members are made by injection in a mold having one or more gaps for adjusting the contact between the dielectric members and the feed network.

14. The device of claim 7 wherein at least some portions of strip lines connected with the output ports contain dielectric substrates placed between the wide walls on both sides of the strip lines.

15. The device of claim 14 including dielectric substrates that are made of a foam-type material having a low dielectric constant.

16. The device of claim 5 wherein each dielectric member is made as one part containing a longitudinal slot for a strip line and a longitudinal hole or channel forming the rod.

* * * * *